US008291535B2

(12) United States Patent
Kemper

(10) Patent No.: US 8,291,535 B2
(45) Date of Patent: Oct. 23, 2012

(54) PRESSURE RELIEVING BODY SUPPORT APPARATUS

(75) Inventor: Christopher E. Kemper, Chico, CA (US)

(73) Assignee: Kemper Support Surfaces, Inc., Carson City, NV (US)

( * ) Notice: Subject to any disclaimer, the term of this patent is extended or adjusted under 35 U.S.C. 154(b) by 425 days.

(21) Appl. No.: 12/012,784

(22) Filed: Feb. 5, 2008

(65) Prior Publication Data

US 2008/0184491 A1 Aug. 7, 2008

Related U.S. Application Data

(60) Provisional application No. 60/899,496, filed on Feb. 5, 2007.

(51) Int. Cl.
*A47C 27/14* (2006.01)
*A47C 27/15* (2006.01)

(52) U.S. Cl. ..... 5/653; 5/655.9; 297/452.27

(58) Field of Classification Search ..... 5/653, 655.9, 5/652, 630, 953, 740, 727–729; 297/452.26, 297/452.27

See application file for complete search history.

(56) References Cited

U.S. PATENT DOCUMENTS

| | | | | | |
|---|---|---|---|---|---|
| 3,158,878 | A * | 12/1964 | Pernell | 5/630 |
| 3,987,507 | A * | 10/1976 | Hall | 5/653 |
| 4,316,298 | A | 2/1982 | Russo et al. | |
| 4,522,447 | A | 6/1985 | Snyder et al. | |
| 4,646,374 | A * | 3/1987 | Shafer | 5/653 |
| 4,682,818 | A * | 7/1987 | Morell | 297/452.27 |
| 4,753,480 | A * | 6/1988 | Morell | 297/452.27 |
| RE32,734 | E | 8/1988 | McLeod | |
| 4,819,288 | A * | 4/1989 | Lowthian | 5/653 |
| 5,294,181 | A | 3/1994 | Rose et al. | |
| 5,452,940 | A | 9/1995 | Maier | |
| 5,513,402 | A | 5/1996 | Schwartz | |
| 6,256,822 | B1 | 7/2001 | Weston et al. | |
| 7,140,057 | B2 | 11/2006 | Hetzel et al. | |
| 7,614,704 | B2 * | 11/2009 | Whelan et al. | 297/452.25 |
| 2008/0184491 | A1 * | 8/2008 | Kemper | 5/653 |

* cited by examiner

*Primary Examiner* — Robert G Santos
(74) *Attorney, Agent, or Firm* — Patterson Thuente Christensen Pedersen, P.A.

(57) ABSTRACT

A body support apparatus, system, and method of reducing pressure on the pelvic structure of a non-ambulatory or semi-ambulatory individual. According to the invention, a body support apparatus provides pressure relief and a level base of pelvic support for wheelchair users. The body support apparatus provides enhanced pressure relief via layers of tissue density-specific pressure relieving layers of foam. In addition, the apparatus provides further pressure relief via gender specific pressure relief zones. The body support apparatus can be used in combination with a wheelchair to provide pressure relief and a pelvic postural support.

18 Claims, 8 Drawing Sheets

Fig. 3
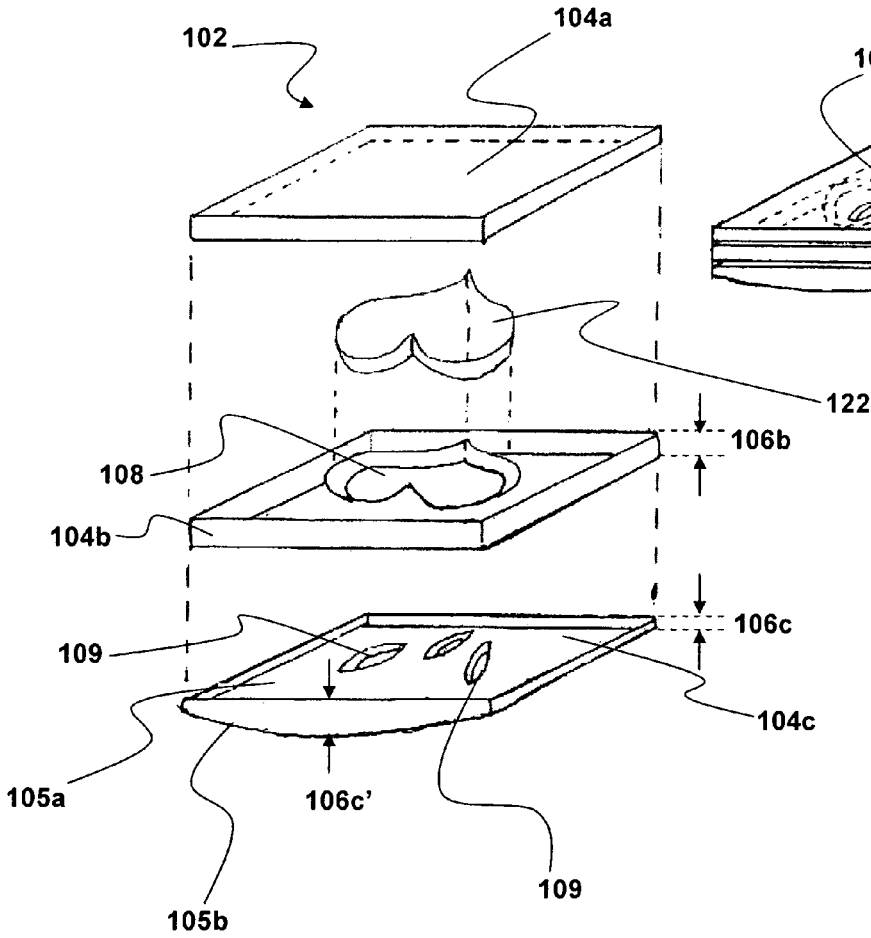
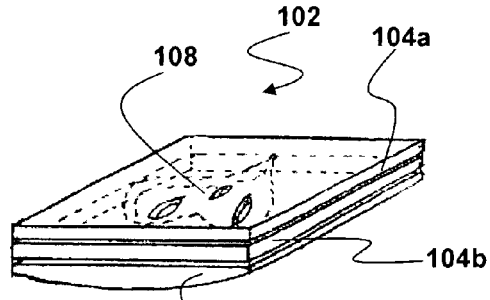
Fig. 2

Fig. 4A
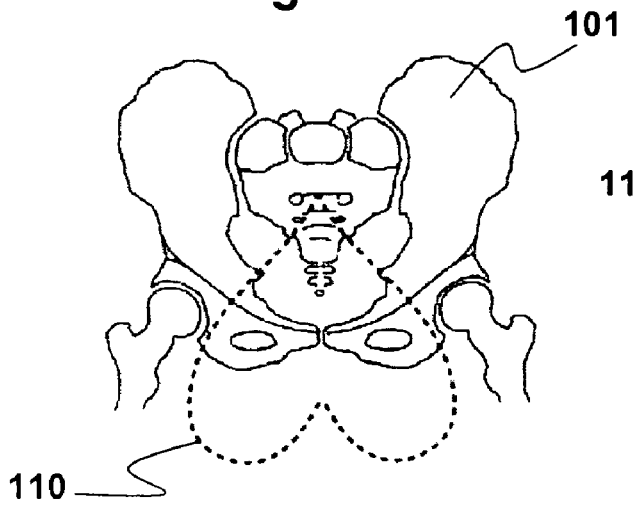
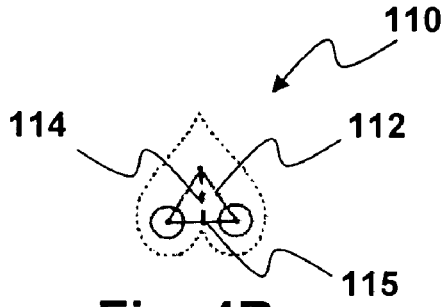
Fig. 4B
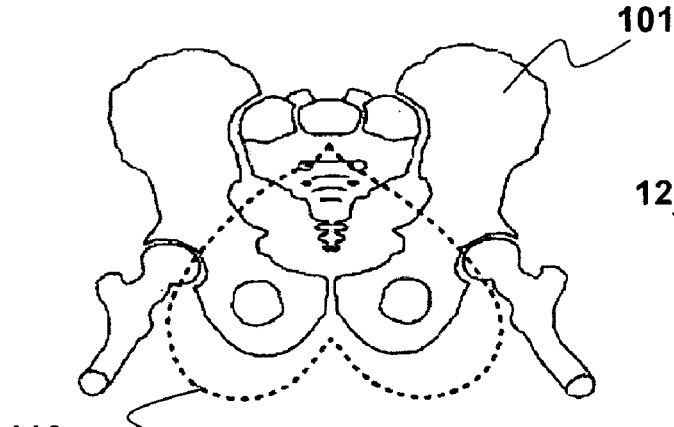
Fig. 5A
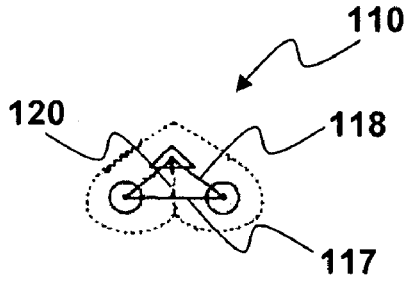
Fig. 5B
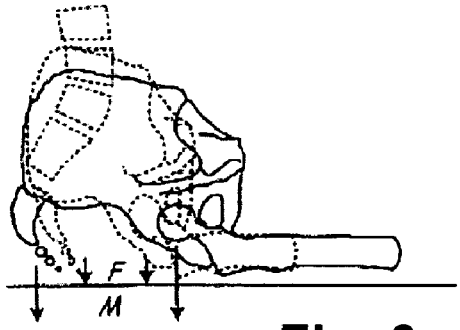
Fig. 6

Fig. 16
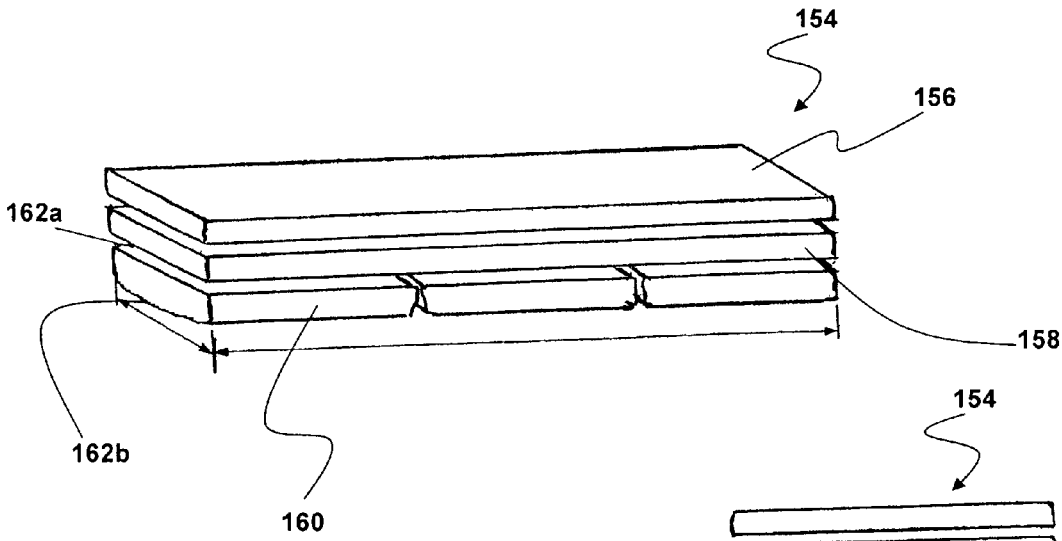
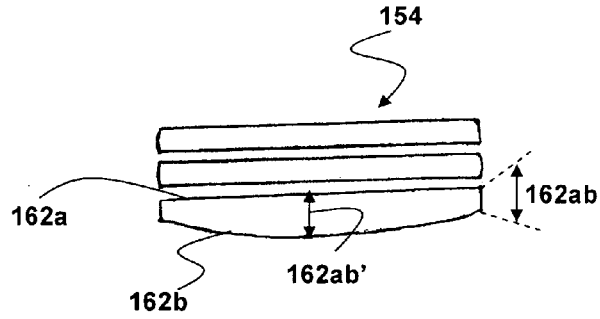
Fig. 16A

PRESSURE RELIEVING BODY SUPPORT APPARATUS

CLAIM TO PRIORITY

This application claims the benefit of U.S. Provisional Application No. 60/899,496, entitled PRESSURE RELIEVING BODY SUPPORT APPARATUS and filed Feb. 5, 2007, which is hereby incorporated by reference in its entirety.

FIELD OF THE INVENTION

The present invention relates generally to therapeutic body support devices. More particularly, the present invention relates to a support cushion for a wheelchair and the like.

BACKGROUND OF THE INVENTION

Many non-ambulatory and semi-ambulatory individuals with either temporary or permanent disabilities use wheelchairs such as, for example, push chairs, motorized wheel chairs, and the like, for mobility. Millions of Americans are presently wheelchair bound or are semi-dependent on a wheelchair. Conventional folding wheelchairs typically have a sling-type seating area with little to no other support and pressure relief. Such sling-type wheelchair seats are subject to sagging. Cushions are often used in addition to the sling type seat. Sagging generally is not ameliorated by low memory foam, low density foam, single layer foam, and/or shifting of gel or air in gel or air seats. This sagging is a key contributor to pressure ulcers and/or pelvic joint strain, and other such injuries. Nosocomial pressure ulcers are a serious complication for people who are injured, disabled, or in the end stage of life. Billion of dollars were spent in the past years on treating pressure ulcers found in non-ambulatory individuals. It is estimated that billings to Medicare and Medicaid for treatment of pressure ulcers, within health care facilities, will triple by 2015.

The sling-type seat, although convenient for collapsible wheelchair seat design, can be uncomfortable, unstable, and contribute to pressure point problems for the user's pelvis such as, for example, increased pressure on the outside, or lateral aspect, of the ischial tuberosities, medial compression of the hip sockets, strain on the buttocks muscles, and/or strain on the supportive ligaments of the pelvis including the sacrotuberous, sacrospinous, pubic, coccygeal, and sacroiliac ligaments.

The wheelchair industry has attempted to provide pressure relief and support at the same time with a number of products. However, despite these efforts, nosocomial pressure ulcers and chronic pelvic pain remain major problems for a rapidly increasing number of people at risk. Manufacturers continue to struggle with wheelchair cushion design in attempt to provide optimal pressure relief and pelvic support.

Thus, there remains a need for a wheelchair cushion designed for improved pressure relief and improved pelvic support.

SUMMARY OF THE INVENTION

The pressure relieving body support apparatus of the present invention provides enhanced pressure relief and pelvic support to the user of a wheelchair. In one embodiment of the invention, the apparatus provides enhanced pressure relief with its unique gradient created by tiered layers of tissue density-specific pressure relieving layers of foam. In addition, the apparatus provides further pressure relief with gender specific pressure relief zones. Further, the apparatus reduces pressure points by returning the pelvis to a more natural and normal posture by reducing wheelchair seat sag inherent in collapsible sling-type wheelchair seats. In one embodiment of the invention, this level base of support can be accomplished by a contoured bottom layer.

Conventional wheelchair cushions do not provide good pressure relief, for three reasons: 1) conventional wheelchair cushions do not provide adequate gradient or tiered tissue density-specific layers for optimal pressure relief; 2) conventional wheelchair cushions are of a "one type fits all" design, instead of providing gender specific pressure relief zones; and 3) conventional wheelchair cushions create pressure points by not providing a level base of support. Further, conventional wheelchair cushions do not provide optimal pelvic support. Instead, conventional wheelchair cushions sag in contour with the collapsible or "sling" type wheelchair seats, thus not providing a level base of pelvic support.

The above summary of the invention is not intended to describe each illustrated embodiment or every implementation of the present invention. The figures and the detailed description that follow more particularly exemplify these embodiments.

BRIEF DESCRIPTION OF THE DRAWINGS

FIG. 2 is a perspective view of a body support apparatus according to one embodiment of the present invention.

FIG. 3 is an exploded view of the body support apparatus depicted in FIG. 2.

FIG. 4A is a schematic depiction of a vertical elevation of a pelvic structure of a male human being.

FIG. 4B is a diagram of a relief zone for a male patient according to one embodiment of the present invention.

FIG. 5A is a schematic depiction of a vertical elevation of a pelvic structure of a female human being.

FIG. 5B is a diagram of a relief zone for a female patient according to one embodiment of the present invention.

FIG. 6 is a schematic depiction of a side elevation of a pelvic structure of a human being.

FIG. 16 is an exploded perspective view of a body support mattress according to one embodiment of the present invention.

FIG. 16A is an exploded end view of a body support mattress according to one embodiment of the present invention.

DETAILED DESCRIPTION OF THE DRAWINGS

Both men and women need protection from tissue damaging pressure at key weight bearing pressure sites. The body support apparatus of the present invention helps provide pressure relief and a level base of pelvic support for wheelchair users. By providing improved pressure relief, the body support apparatus of the present invention can allow improved circulation to skin, muscles, and joints. In one embodiment of the present invention, improved circulation to skin and muscles is facilitated by layered or tiered tissue density-specific pressure relief in locations where nosocomial ulcers typically form. In addition, as depicted generally in FIG. 3, the body support apparatus of the present invention helps provide a level base of support. Providing a level base of support can prevent chronic pelvic pain.

Figure 1A:
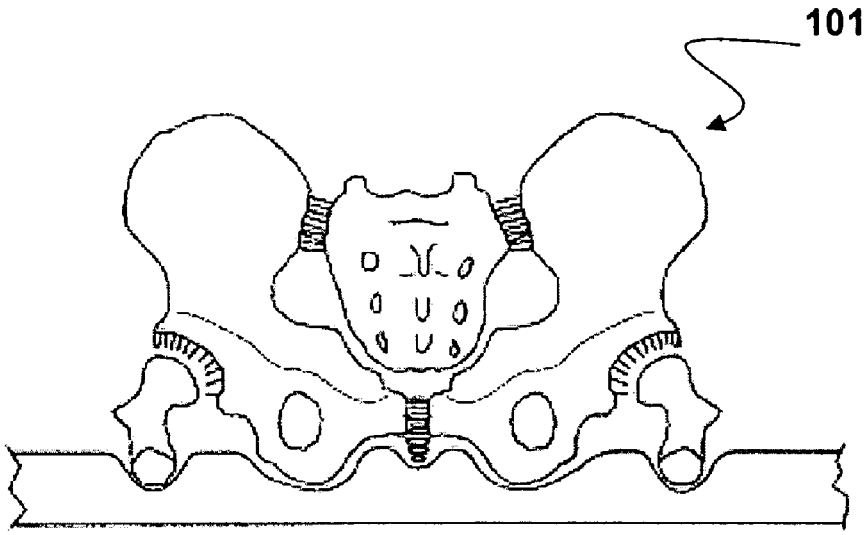
FIG. 1A is a perspective view of normal pelvic joint alignment of a human being.
Figure 1B:
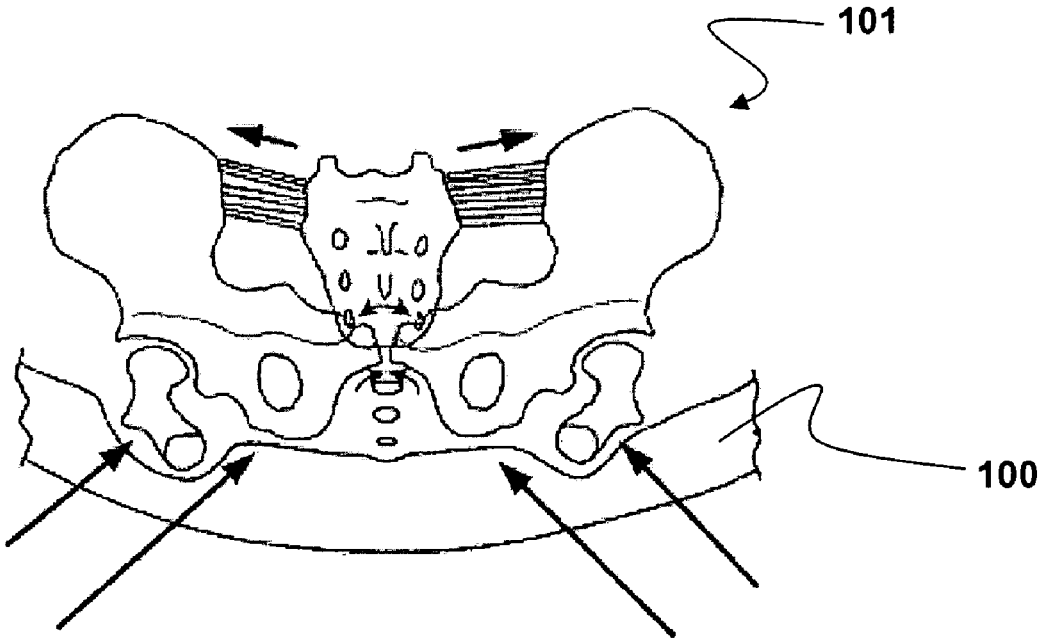
Fig. 1B Prior Art
FIG. 1B is a perspective view of joint alignment when using a prior art wheelchair seat.

Chronic pelvic pain may result from pressure and strain created in the pelvic structures, such as, for example, hip sockets, pubic, coccyx, sacroiliac, lumbosacral, and other joints. As depicted in FIG. 1B, such pressure and strain can be created while sitting in a sling-type seat 100 which does not provide a level base of support.

Referring to FIGS. 2 and 3, to provide improved pressure relief, a body support apparatus 102 of the present invention can comprise multiple, distinct, tiered layers of one or more materials to create a gradient of tissue density-specific pressure relieving layers. In one embodiment of the invention, a body support apparatus 102 can comprise a top layer 104*a*, at least one intermediate layer 104*b*, and a bottom layer 104*c*, each of a density specific material. Layers 104 can comprise one or more materials, such as, for example, foam, plastic, rubber, cloth, down, and other such materials. Layers 104 can comprise the same or different materials than other layers.

In one particular embodiment of the invention, each layer 104 comprises a specific type of foam. Foams can be characterized by their corresponding Indention Force Deflection (IFD) rating, otherwise known as the Indention Load Deflection (ILD), which is the international scale for memory and is based on a scale ranging from 0-100. Indentation force deflection is defined as the measure of the load-bearing capacity of flexible foam. It is generally measured as the force in pounds required to compress a fifty square inch circular indenter foot into a 4 inch thick sample no smaller than 24 inches square to a stated percentage of the sampled initial height. Common ILD values are generated at 25 and 65 percent of initial height. See http://www.pfa.org/jifsg/jifsgs15.html, incorporated herein by reference in its entirety. The details of this measurement are defined in reference test method ASTM D3574 which is also incorporated herein by reference in its entirety. The ILD values identified in the present application are based on a twenty five percent deflection. Foams also have a rate of recovery. Recovery is defined as the return to original dimension and properties of a foam sample after a deforming force is removed.

Top layer 104*a* provides for soft support of the user's skin. In one embodiment of the present invention, top layer 104*a* comprises a high density (2.8-4.5 pound per cubic foot), low ILD foam having an ILD in the range from about 10 to about 24 pounds/fifty square inches or less at twenty-five percent deflection. Two example foams are natural Talalay latex foam and non-viscoelastic polyurethane foam made with petroleum-based polyurethane or mixtures of petroleum-based and soy-based polyols. Herein all references to polyurethane include, but are not limited to, various formulations of non-viscoelastic, non-conforming non-memory foam type variations of polyurethane foam containing polyols, either petroleum-based or soy-based.

Intermediate layer(s) 104*b* provides for medium support of the patient's muscles. In one embodiment of the present invention, intermediate layer 104*b* comprises a medium density, medium memory foam such as, for example, a foam having a density ranging from about 1.8 to about 2.3 pounds per cubic foot, with an ILD in a range from about 25 to about 35 pounds/fifty square inches or less at twenty-five percent deflection.

Bottom layer 104*c* provides for firm support of the patient's pelvic joints and protuberances. In one embodiment of the present invention, bottom layer 104*c* comprises a medium density, high memory foam, such as, for example, a foam have a density in a range from about 2.8 to about 4.5 pounds per cubic foot, with an ILD ranging from about 75 to about 100 pounds/fifty square inches at twenty-five percent deflection. One such foam can comprise a 2.8 pound, 80-90 ILD polyurethane foam.

Each layer 104 includes a sufficient thickness 106 to accomplish its desired function whether it is pressure relief, pelvic support, and/or some additional function. Thickness 106 can be substantially the same at any location within layers 104, or can vary from 106*c* to 106*c*' to create a wedge shaped or contoured layers 104.

In one embodiment of the invention, depicted in FIG. 3, bottom layer 104*c* includes a first major surface 105*a* and a second major surface 105*b*. First major surface 105*a* is substantially planar. Second major surface 105*b* conforms substantially to a catenary curve to accommodate the sling-type seat of a wheelchair, with a varying thickness 106*c*, so that first surface 105*a* provides a level base support. For example, thickness 106*c* to 106*c*' can vary within the range of about one quarter of an inch to one inch on each side to about 2.5-3.5 inches in the middle. Further, intermediate layer 104*b* can comprise a substantially constant thickness from back to front to create a generally planar layer, or can comprise a varying thickness to create a non-planar layer generally tapering from thicker to thinner from back to front.

Referring to FIGS. 2 and 3, in one embodiment of the present invention, body support apparatus 102 further includes gender-specific pressure relief zones 108 and 109. Relief zones 108 and 109 provide further pressure relief adapted to accommodate the female and male anatomy. Pressure relief zones 108 and 109 can be specifically formed from humans where impressions of male and female pelvic floor anatomy are taken for the purpose of identifying the differences in male and female pelvic floor pressure points for specific individuals. Pressure relief zones 108 and 109 may lie within layers 104*b*, 104*c*, or both. As depicted in FIGS. 4-6, the male pelvic structure as depicted in FIG. 4A is deeper front to back and much narrower side-to-side than the female pelvic structure as depicted in FIG. 5A, which is considerably wider side-to-side and narrower front to back when considering the epicenters of the three main weight bearing or pressure points (two ischial tuberosities and one coccyx). Referring to FIG. 4B, the male epicenter 110 forms a substantially acute triangle 112, with a base 115 that is narrower than female base 117, and has an altitude 114 that is greater than altitude 120 seen in the female pelvic floor pressure points as shown in FIG. 5B.

Figure 8:
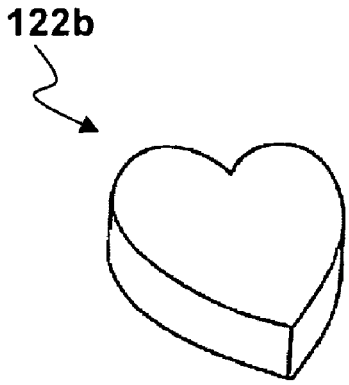
FIG. 8 is a perspective view of a pressure relief insert according to one embodiment of the present invention.
Figure 9:
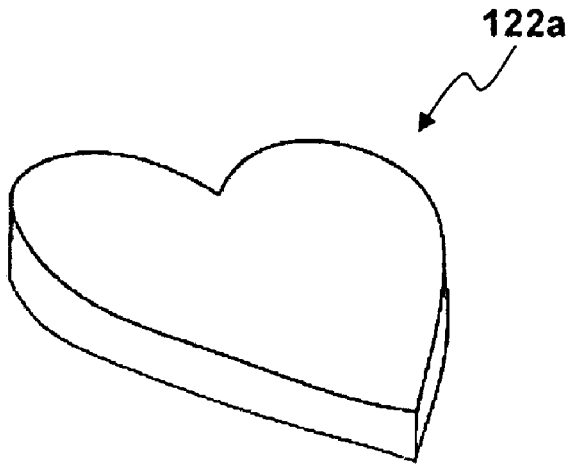
FIG. 9 is a perspective view of a pressure relief insert according to one embodiment of the present invention.

In one embodiment of the present invention, illustrated in FIG. 3, relief zone 108 includes an insert 122 that can be inserted into a cutout portion or cavity of layer 104*b*. In another embodiment, referring to FIG. 3, the cavity of layer 104*b*, relief zone 108, is filled with insert 122 that contains a higher density and lower ILD foam than that which comprises pressure relief zone 108 which insert 122 replaces. Insert 122 adds protection, for either male or female anatomical pressure points, by filling pressure zone 108 with foam of density and memory similar to or identical to the soft top layer 104*a* which has, for example, a cubic foot density of about 2.8 to about 4.5 pounds and about a 10-24 ILD. Cavity 108 and insert 122 contain the three pressure points whose epicenters form a triangular shape corresponding to the triangular relationship of the ischial tuberosities and the coccyx, as described above. The triangular relationship of the insert is depicted in FIGS. 4B and 5B and comprises triangle 112 or 118 having a base 115 or 117 extending a distance corresponding to the distance from approximately a midpoint of the base to the coccyx. The midpoint is not necessarily half way between the ends of the base because many individuals have some anatomical asymmetry. Insert 122 can comprise any suitable shape that encompasses this generally triangular relationship, for example, a heart-shape, oval, round, square, rectangular, and other suitable shapes. In an example embodiment, depicted in FIGS. 7-9, insert 122 is a heart-shape (cardioid.)

Figure 7:
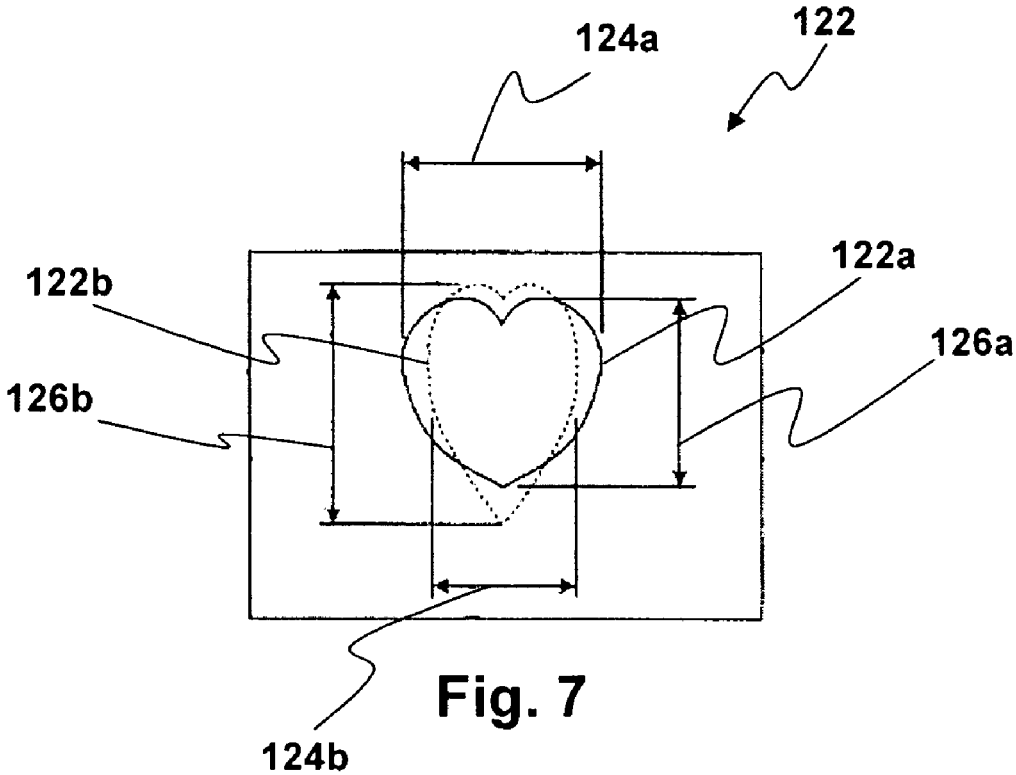
FIG. 7 is a plan view of a pressure relief insert according to one embodiment of the present invention.

Referring to FIG. 7, the shape of cutout 108 and insert 122 is gender specific. Referring to FIG. 3, the shape of cutouts 109, in layer 104*c*, are also gender-specific but are reduced in surface area to that which approximates the actual size and shape of the ischial tuberosities and the coccyx that make up the epicenters of the three points of the gender specific triangle and correspond directly to the size and shape of triangles 112 or 118. Whereas cavity 108, in layer 104*b*, is filled with, for example, high density low ILD latex or non-viscoelastic polyurethane foam, forming insert 122, cutouts 109 may or may not be filled with any material. Whether cutouts 109, in layer 104*c*, are filled with material like that which comprises insert 122, or whether they remain empty, whether in male or female triangular configurations, they remain in anatomical relationship to the pelvic floor pressure points created by the ischial tuberosities and the coccyx. The triangular gender-specific pressure relief zone, with or without soft insert, such as described above for insert 122, provides pressure relief. Referring again to FIG. 7, insert 122*a* for a female patient has a width 124*a* and a height 126*a*, whereas insert 122*b* for a male patient has a width 124*b* and a height 126*b*. Generally, width 124*a* is greater than width 124*b*, and/or height 126*a* is less than height 126*b*. Therefore, custom support of the weight bearing pressure points is achieve by specific male and female pressure relief zones 108 and 109 to accommodate the differences in the male and female pelvic floor skeletal anatomy.

Insert 122 can optionally be designed specifically for an individual where triangles 112 and 118 can be custom fit by taking impressions of the individual's pelvic floor pressure points, whether male or female. Also, inserts can be designed specifically for an individual to fill pressure zones 109.

Figure 10:
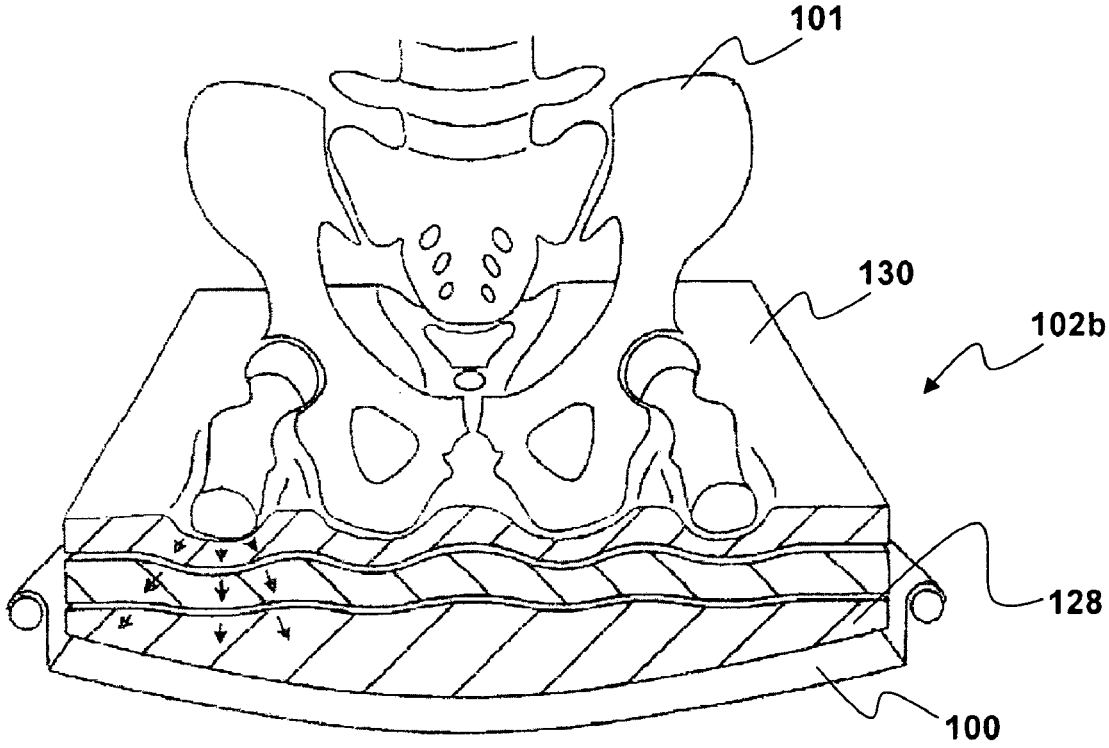
FIG. 10 is a schematic perspective view of joint alignment when using a body support apparatus of the present invention.
Figure 12:
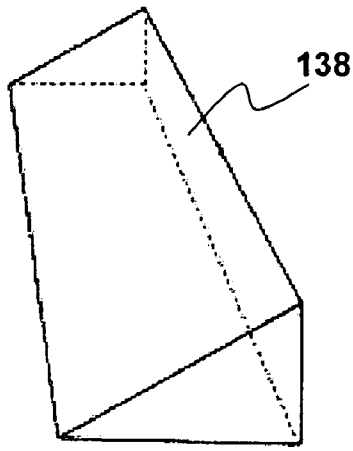
FIG. 12 is a perspective view of an insert of a body support mattress according to one embodiment of the present invention.

Body support apparatus 102 also provides a level base of support and pelvic postural support, as depicted in FIG. 10. As compared to traditional wheelchair cushions that conform to the sag of the wheelchair's sling-type seat, body support apparatus 102 of the present invention compensates for the wheelchair's seat sag by conforming to the seat sag on its bottom side 105*b* while creating a level, generally planar, base of support on top side 105*a* for the user. Pelvic postural support is important to prevent the formation of pressure ulcers and general discomfort due at the pressure points created by lack of a level seat.

In addition, this embodiment of the present invention reduces strain on all pelvic joints including the hip sockets, sacroiliac joints, pubic joints, and coccygeal joints by virtue of eliminating seat sag-induced lateral forces that are illustrated in FIG. 1B while reducing pressure on the ischial tuberosities and/or coccyx. Pressure points at both the pelvic joints (hip socket, sacroiliac, pubic, and coccygeal) and the pelvic floor pressure points (sacral tuberosities and coccyx) are contributors to the formation of pressure ulcers. A level base support, as illustrated in FIG. 10, returns the pelvis back to its natural sitting position where the pelvis can tolerate load most efficiently.

The present invention provides a body support apparatus within the seating area of a wheelchair that reduces pressure on the pelvic structures and protects against pressure ulcers at the weight bearing points of the pelvic floor for the non-ambulatory or semi-ambulatory individual by one or more of the following mechanisms:

1. Reducing sling-induced lateral compression of the pelvis;

2. Providing optimal pressure reduction for both male and female users by adding gender-specific pressure relief zones; and 3. Gradient pressure relief created by tiered layers or tissue density-specific foam with density the same or similar to human tissue such as skin/fat, muscle, and joints.

In another aspect of the invention, a method of reducing pressure on the pelvic structure of a non-ambulatory or semi-ambulatory individual includes providing a body support apparatus in combination with a seating area of a wheelchair, such as a sling-type seat, wherein the body support apparatus comprises a gradient created by tiered layers of tissue density-specific pressure relieving layers of foam, and a gender specific relief zone within the tiered layers.

A system for reducing pressure on the pelvic structure of a non-ambulatory or semi-ambulatory individual includes a traditional wheelchair with a sling-type seating area, and a body support apparatus comprising a gradient created by tiered layers of tissue density-specific pressure relieving layers of foam, and a gender specific relief zone within the tiered layers.

Figure 11:
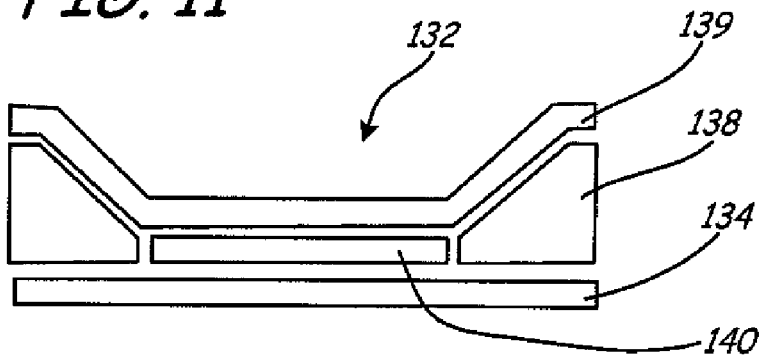
FIG. 11 is a cross section of a body support mattress according to one embodiment of the present invention.
Figure 13:
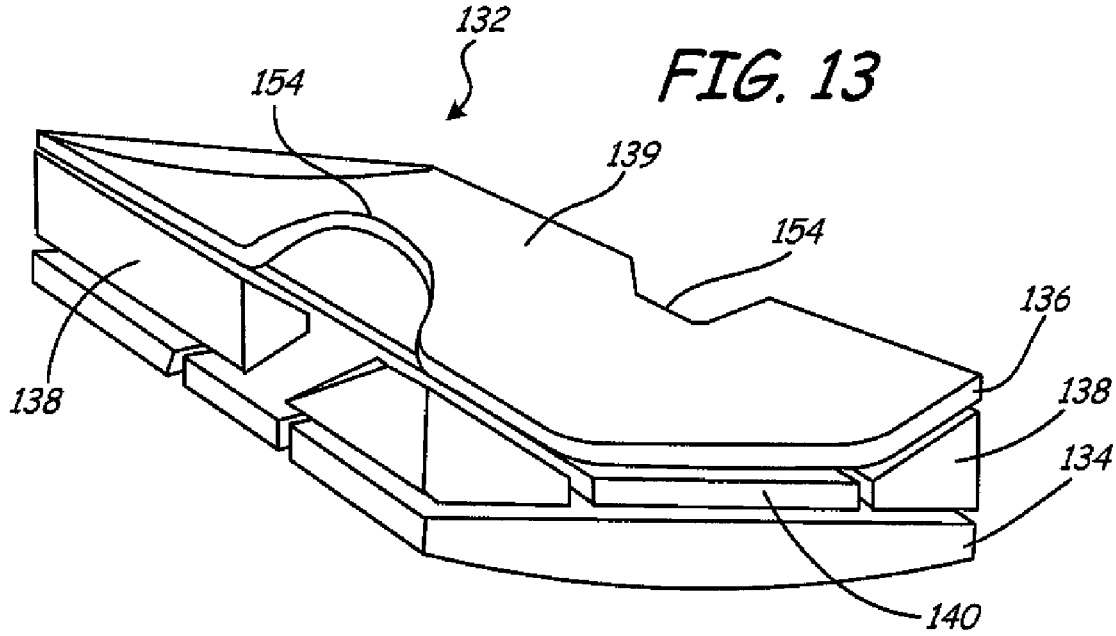
FIG. 13 is a partially cut-away perspective view of a body support mattress according to one embodiment of the present invention.
Figure 14:
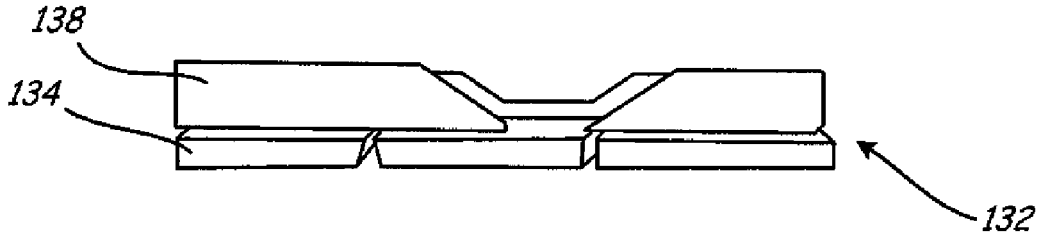
FIG. 14 is a side elevational view of a body support mattress according to one embodiment of the present invention.

Referring to FIGS. 11-14, in one embodiment of the present invention, body support apparatus 102 comprises a pressure relief mattress 132. Related mattresses are described in U.S. Provisional Application 60/830,363, entitled "Spinal Tension and Pressure Relieving Body Support Apparatus," filed Jul. 12, 2006, incorporated herein by reference. The annotated dimensions in FIGS. 11, 13, and 14 represent examples and are not to be considered limiting in any manner. In one embodiment of the invention, mattress 132 comprises a similar gradient created by tiered layers of tissue density-specific pressure relieving layers of foam and a relief zone within the tiered layers. Depicted in FIG. 11, mattress 132 comprises a bottom layer 134, a top layer 136, at least two intermediate inserts 138, and a relief zone 140. Bottom layer 134 conforms to the sag of typical hospital beds where spring-based bed frames allow for a side-to-side hammock effect. In one embodiment of the present invention, not unlike the previously discussed wheelchair bottom layer side 105*b* that is curved to conform to the sling or sag of the wheelchair seat, where the top side 105*a* of wheelchair cushion base layer 104*c* creates a level generally planar base of support for the user. The same sag-leveling base layer is incorporated into the present embodiment, for example, in base layer 134 depicted in FIG. 13. Overall postural support, not just pelvic support, is important to prevent the formation of pressure ulcers and general discomfort due at the pressure points created by lack of a level bed. In addition, this embodiment of the present invention reduces strain of all spinal and pelvic joints including the shoulders, rib cage, hip sockets, sacroiliac joints, pubic joints, and coccygeal joints and the thighs by virtue of eliminating mattress or bed sag-induced lateral forces. In addition to improving the rest or sleep posture of the patient, bed leveling layer 134 helps to protect against pressure points known to cause pressure ulcers throughout the length of the human anatomy.

As depicted in FIGS. 13 and 14, the pressure relief mattress 132 further comprises a cut-away section 154 in ridge 139 to accommodate a user's limbs, such as an arm. Section 154 provides an area for resting an arm and/or extending the arm beyond the edge of mattress 132. The structure of the embodiment depicted in FIGS. 11-14 reduces that risk that a patient will roll out of a bed and suffer an injurious fall.

Figure 15:
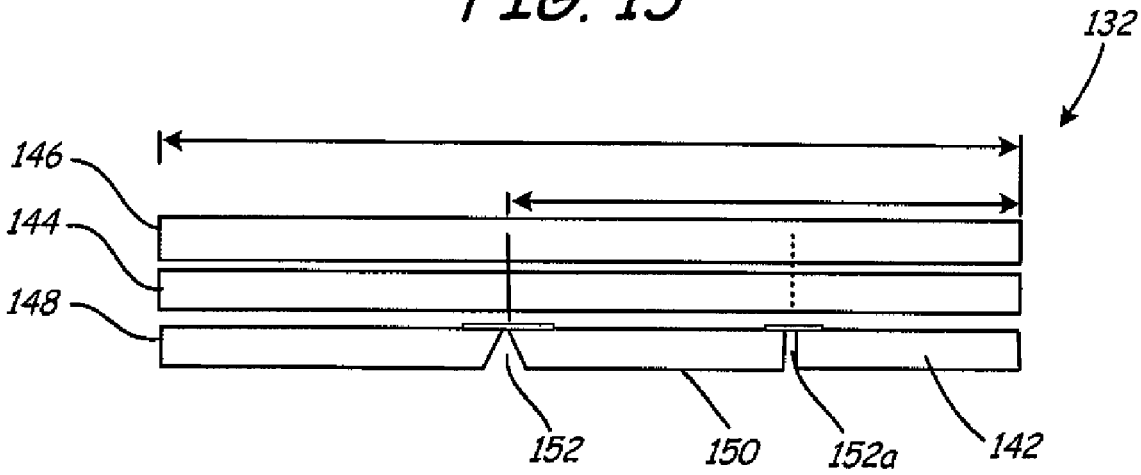
FIG. 15 is a side view of a body support mattress according to one embodiment of the present invention.
Figure 15A:
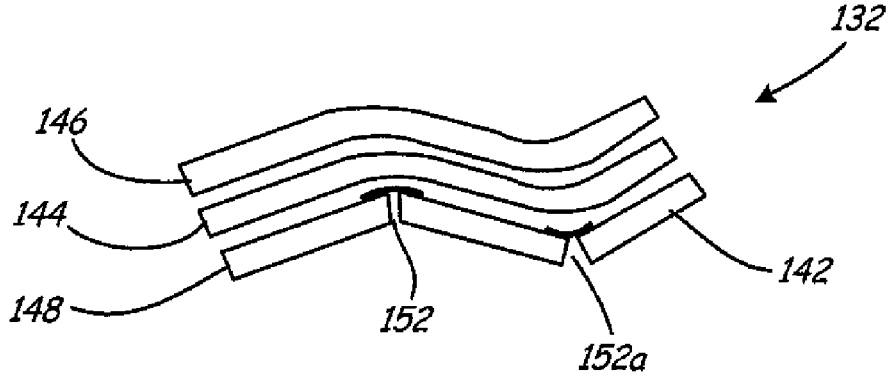
FIG. 15A is a side view of a body support mattress in an inclined position according to one embodiment of the present invention.

FIGS. 15 and 16 depict further example embodiments of a body support mattress 132. Referring to FIG. 15, mattress 132 comprises a bottom layer 142, an intermediate layer 144, and a top layer 146. Bottom layer 142 further comprises a first major surface 148 and a second major surface 150. Bottom layer 142 comprises can comprise notch 152 and/or 152*a*. Notches 152 and 152*a* lie along the longitudinal axis of bottom layer 142 and act as a hinge for bed inclination. Referring to FIG. 16, in one embodiment of the invention, notch 152 lays about one third of the way from the foot of the bed. Notch 152*a* lays about one third of the way from the head of the bed. Notch 152 can comprise a "V" shape that is wider at surface 148 than at surface 150. In another embodiment, notch 152*a* is the same width on both surfaces 148 and 150. Both notches 152 and 152*a* are contained in bottom layer 142 and the pieces of layer 142, created by notches 152 and 152*a*, are fastened into approximation with each other by a flexible material (not shown) affixed to surface 148 along the axis of the notch. No such material is affixed to surface 150 to enable free articulation of layer 142 in conformity with an articulating bed frame. The notches are spaced equidistant from each end for purpose of articulation according to one embodiment of the present invention. The annotated dimensions in FIGS. 15 and 15A are exemplary and are not to be considered limiting in any manner.

A body support mattress 154 is depicted in FIGS. 16 and 16A, as set forth in U.S. Provisional Application 60/830,363. The dimensions in FIGS. 16 and 16A are examples and are not to be considered to be limiting in any manner. Mattress 154 provides continuous pressure relief at all points since the support is an integral part of the unique body support system. Each point of support is created by multiple cushioning components. Each layer of foam substance approximates the texture and density of the tissue it supports.

Referring to FIGS. 16 and 16A, a surface layer 156 is the top or body comfort layer. Surface layer 156 may be, for example, about 2 to about 4" of latex or polyurethane foam that has the same or similar density and consistency of human skin and subcutaneous fat. Surface layer 156 is so designed in density (pounds per cubic foot) and memory (ILD) that it nurtures the sensitive skin layer by yielding with a tactile likeness such that pressure points are reduced or eliminated. The material selected, in this embodiment, is ultra soft, non-collapsing non-heat sensitive, non-viscoelastic foam for continuous support. The foam described in this embodiment can have a density of about 2.8 to about 4.5 pounds per cubic foot, and an ILD in the range from about 10 to about 24 pounds per fifty square inches or less at twenty-five percent deflection.

The second layer 158, or muscle comfort layer, can comprise a polyurethane foam element with the same or similar density of relaxed human muscle. In one embodiment of the present invention, middle or muscle layer 158, for example, has a density ranging from about 1.8 to about 2.3 pounds per cubic foot, with an ILD in a range from about 25 to about 35 pounds per fifty square inches or less at twenty-five percent deflection. It supports the denser and heavier muscle tissues between the fat layer and above or superficial to the bone and joint layers of the human body by providing continuous higher ILD or memory with a less dense rating, necessary for muscle relations.

The core layer 160 of this present invention supports the spine and joints deep within the core of the human body. Core layer 160 of this embodiment, for example, can include a polyurethane foam with a density in a range from about 2.8 to about 4.5 pounds per cubic foot, with an ILD range from about 75 to about 100 pounds per fifty square inches or less at twenty-five percent deflection. One such foam can comprise a 2.8 pound, 80-90 ILD polyurethane foam. It supports the spine not allowing the pelvis and sacrum to sag into hyperextension. Hyperextension and narrowing of the nerve passageway due to spinal joint overlap is minimized while the consumer or patient is on their back. Similarly tension or pressure on the spinal nerves is reduced by the tension relieving body support cushion by reducing sag of the spine laterally while the patient or consumer is on their side, effectively reducing pressure and tension on spinal nerves. The spine support layer supports the denser and heavier spinal joint tissues where the nerves exit the spine by providing highest necessary memory while maintaining continuous firmer support necessary for spine relaxation and decompression. Core layer 160 can also comprises one or more notches along the longitudinal axis of bottom layer 142 and act as a hinge for bed inclination, similar to notches 152 and 152*a* of FIG. 15.

In one embodiment of the invention, core layer 160 conforms to the sag of typical hospital beds where spring-based bed frames allow for a side-to-side hammock effect. In one embodiment of the present invention, not unlike the previously discussed wheelchair bottom layer side 105*b*, bottom side 162*b* is curved to conform to the sling or sag of the hospital bed, while top side 162*a* is generally planar. A thickness 162*ab* at the edges of core layer 160 is generally less than the thickness 162*ab*' towards the middle of core layer 160.

The spinal tension pressure relieving body support apparatus 102 of the present invention can provide continuous pressure relief at all point of its surface area because its unique support characteristics are of an integrated, continuous, and contiguous design that does not create any zone of diminished pressure or tension relief. These features are not only beneficial for the circulatory system, but for the musculoskeletal system as well.

Referring to FIGS. 4*b*, 5*b*, 7, 8 and 9, in another aspect, the invention includes at least two body support apparatus 102, one of which is adapted to accommodate the female pelvic anatomy and the other of which is adapted to accommodate the male pelvic anatomy. As has been previously discussed, each body support apparatus 102 includes insert 122. Insert 122 is formed to provide pressure relief at three locations that form a triangle. These three locations generally conform to the location of the coccyx and the two ischial tuberosities. The three pressure relief points form a triangle which for the female insert 122*a* has a base extending from the points associated with the ischial tuberosities and an altitude extending from the base to the point associated with the coccyx. The relative relationship between the female insert 122*a* and the male insert 122*b* is that the base measurement for the female insert 122*a* is greater than that of the male insert 122*b*. In addition, the length of the altitude 114 of the female insert 122*a* is shorter than the altitude 114 of the male insert 122*b*.

The inserts 122 may be substantially cardioid or heart shaped. Inserts 122 may also be generally triangular in shape. Inserts 122 may also include two or three separate structures arranged in a triangular pattern.

In another aspect of the invention, the invention includes a method of designing an insert 122, specifically for a particular individual. The method includes measuring a relative relationship between the ischial tuberosities and the coccyx for that individual and forming an insert 122 in which the triangular relationship of the insert corresponds to the triangular relationship of the ischial tuberosities and the coccyx for that individual.

Another aspect of the invention includes a cushion support having a bottom surface that is substantially catenary or cylindrical shaped and a top surface that is substantially planar in shape. This cushion can be placed on a sling type wheelchair sheet to provide a substantially level and planar sitting surface. In addition to the sag-reducing feature of this embodiment of the invention, referring to FIG. 3 at layer 104*c*, are additional pressure relieving cutouts 109 that, like cutout 108, provide continuous gender-specific pressure relief.

The invention may be embodied in other specific forms without departing from the essential attributes thereof; therefore, the illustrated embodiments should be considered in all respects as illustrative and not restrictive. The claims provided herein are to ensure adequacy of the present application for establishing foreign priority and for no other purpose.

What is claimed is:

1. A multi-layer therapeutic body support apparatus adapted for accommodating a sitting human, the apparatus comprising:

a bottom foam layer having a first density and a first indentation force deflection sized and shaped to fit a seating structure;

a second foam layer adjacent to and coextensive with the bottom foam layer located above the bottom foam layer, the second foam layer having a second density and a second indentation force deflection, the second foam layer having only a single cavity extending from a first major surface into the second foam layer wherein the single cavity therein is shaped and positioned to simultaneously accommodate in three point relation two ischial tuberosities and a coccyx of a pelvis; and a single pressure relief insert positioned within the cavity of the second foam layer, wherein the insert has a different density than the second density and a different indentation force deflection than the second indentation force deflection of the second foam layer and wherein the single pressure relief insert is shaped to be received in the cutout in closely fitting relation to the cutout; and wherein the first indentation force deflection is greater than the second indentation force deflection.

2. The multi-layer therapeutic body support apparatus of claim 1, further comprising:

a top foam layer having a third density and a third indentation force deflection, wherein the second foam layer is positioned intermediate at least the bottom foam layer and the top foam layer and coextensive with both the bottom foam layer and the top foam layer.

3. The multi-layer therapeutic body support apparatus of claim 2, wherein the third indentation force deflection is less than the first indentation force deflection and the second indentation force deflection.

4. The multi-layer therapeutic body support apparatus according to claim 2, wherein the top foam layer comprises latex foam or polyurethane-based foam.

5. The multi-layer therapeutic body support apparatus according to claim 2, wherein the third indentation force deflection is in a range from about ten to about twenty-four pounds per fifty square inches at twenty-five percent deflection.

6. The multi-layer therapeutic body support apparatus according to claim 2, further comprising:

at least one additional foam layer in addition to the second foam layer, the at least one additional foam layer being intermediate to and coextensive with the bottom foam layer and the top foam layer.

7. The multi-layer therapeutic body support apparatus of claim 1, wherein the insert comprises a pressure relieving area or areas located generally corresponding to a triangular relationship of human ischial tuberosities and a coccyx of a pelvis, wherein the generally triangular relationship of the pressure relieving area or areas is defined as a triangle having a base extending a distance corresponding generally to the distance between the two ishcial tuberosities, and an altitude extending a distance generally corresponding to the distance from the base generally to the coccyx.

8. The multi-layer therapeutic body support apparatus of claim 7, wherein the pressure relief insert is structured to be gender-specific such that the pressure relief insert is either an insert shaped for a female patient or an insert shaped for a male patient.

9. The multi-layer therapeutic body support apparatus according to claim 8, wherein the insert shaped for a female patient has a base greater than a base of the insert shaped for a male patient and/or an altitude less than an altitude of the insert shaped for a male patient.

10. The multi-layer therapeutic body support apparatus according to claim 1, wherein the body support apparatus comprises a wheelchair cushion.

11. The multi-layer therapeutic body support apparatus according to claim 10, wherein the bottom foam layer comprises a first generally planar surface proximate the second foam layer, and a non-planar second surface adapted to conform to a seating area of a wheelchair.

12. The multi-layer therapeutic body support apparatus according to claim 1, wherein the second foam layer comprises polyurethane foam.

13. The multi-layer therapeutic body support apparatus according to claim 12, wherein the second density is in a range from about one and eight tenths to about two and three tenths pounds per cubic foot.

14. The multi-layer therapeutic body support apparatus according to claim 1, wherein the second indentation force deflection is in a range from about twenty-five to about thirty-five pounds/fifty square inches at twenty-five percent deflection.

15. The multi-layer therapeutic body support apparatus according to claim 1, wherein the bottom foam layer comprises polyurethane foam.

16. The multi-layer therapeutic body support apparatus according to claim 15, wherein the first density is in a range from about two and eight tenths to about four and one-half pounds per cubic foot.

17. The multi-layer therapeutic body support apparatus according to claim 1, wherein the first indentation force deflection is in the range from about seventy-five to about one hundred pounds/fifty square inches at twenty-five percent deflection.

18. A method of making a multi-layer therapeutic body support apparatus, comprising:

bonding a bottom foam layer having a first density and a first indentation force deflection to a second foam layer adjacent to and coextensive with the bottom foam layer, the second foam layer having a second density and a second indentation force deflection, the second foam being sized and shaped to fit a seating structure;

cutting only a single cavity extending from a first major surface into the second foam layer the single cavity being shaped and positioned to simultaneously accommodate in three point relation two ischial tuberosities and a coccyx of a pelvis;

inserting a pressure relief insert into the cavity of the second foam layer, wherein the single pressure relief insert is shaped to be received in the cutout in closely fitting relation to the cutout and the insert has a different density than the second density and a different indentation force deflection than the second indentation force deflection of the second foam layer; and selecting the first indentation force deflection to be greater than the second indentation force deflection.

* * * * *